US008961741B2

(12) United States Patent
Knopp et al.

(10) Patent No.: US 8,961,741 B2
(45) Date of Patent: Feb. 24, 2015

(54) DEVICE FOR RETAINING DOCTOR BLADES

(75) Inventors: Joachim Knopp, Hückeswagen (DE); Axel Borgmann, Hückeswagen (DE)

(73) Assignee: Joh. Clouth GmbH & Co. KG, Hückeswagen (DE)

( * ) Notice: Subject to any disclaimer, the term of this patent is extended or adjusted under 35 U.S.C. 154(b) by 0 days.

(21) Appl. No.: 14/240,964

(22) PCT Filed: Aug. 14, 2012

(86) PCT No.: PCT/EP2012/065874

§ 371 (c)(1), (2), (4) Date: Feb. 25, 2014

(87) PCT Pub. No.: WO2013/029988

PCT Pub. Date: Mar. 7, 2013

(65) Prior Publication Data

US 2014/0216674 A1 Aug. 7, 2014

(30) Foreign Application Priority Data

Aug. 31, 2011 (DE) ..... 10 2011 081 926

(51) Int. Cl.
*B31F 1/12* (2006.01)

(52) U.S. Cl.
USPC ..... 162/280

(58) Field of Classification Search
USPC ..... 162/280, 281, 272, 199, 263
See application file for complete search history.

(56) References Cited

U.S. PATENT DOCUMENTS

| | | | | |
|---|---|---|---|---|
| 3,854,162 | A | 12/1974 | Russel | |
| 6,087,950 | A * | 7/2000 | Capan | 340/665 |
| 6,328,853 | B1 * | 12/2001 | Goodnow et al. | 162/281 |
| 6,687,950 | B1 * | 2/2004 | Rata et al. | 15/256.51 |
| 2006/0054293 | A1 | 3/2006 | Strauch | |
| 2007/0163738 | A1 | 7/2007 | Kurkinen | |
| 2009/0148208 | A1 | 6/2009 | Gauvin et al. | |

FOREIGN PATENT DOCUMENTS

| | | | |
|---|---|---|---|
| DE | 195 08 298 | A1 | 9/1996 |
| EP | 1567715 | B1 | 5/2006 |
| WO | WO 2006/010794 | A1 | 2/2006 |
| WO | WO 2009/076128 | A1 | 6/2009 |

OTHER PUBLICATIONS

International Search Report issued by the European Patent Office in International Application PCT/EP2012/065874 on Sep. 20, 2012.

* cited by examiner

*Primary Examiner* — Mark Halpern
(74) *Attorney, Agent, or Firm* — Henry M. Feiereisen LLC

(57) ABSTRACT

A device for retaining doctor blades includes a support element and a retaining finger with a doctor blade pocket inserted between the support element and the retaining finger. The support element and the retaining finger are constructed as a single piece.

9 Claims, 2 Drawing Sheets

DEVICE FOR RETAINING DOCTOR BLADES

CROSS-REFERENCES TO RELATED APPLICATIONS

This application is the U.S. National Stage of International Application No. PCT/EP2012/065874, filed Aug. 14, 2012, which designated the United States and has been published as International Publication No. WO 2013/029988 and which claims the priority of German Patent Application, Serial No. 10 2011 081 926.6, filed Aug. 31, 2011, pursuant to 35 U.S.C. 119(a)-(d).

BACKGROUND OF THE INVENTION

The invention relates to a device for retaining doctor blades with a support element and a retaining finger having the doctor blade pocket, wherein the doctor blade is inserted between the support element and the retaining finger.

A scraping device or scraper blade, also referred to as a doctor blade, has the task, among others, to clean the surface of a roller or a cylinder. In the case of a paper machine, such a doctor blade has the effect that the paper web guided across the respective roller of the paper machine is not wound up on the roller in the event of a web break, but exits the roller at the predetermined position to reach, for example, a collection tray. This doctor blade must ensure that this task is performed with 100% certainty, since otherwise considerable failures would occur in the papermaking process, possibly even damage the paper machine. The doctor blade also has the task to clean the surface of the roller so that the paper web is not marked. For this reason, the doctor blade attached to its holder must be in contact with the roller as uniformly as possible over its entire length. For pressing the doctor blade onto the roller surface, the holder is generally constructed in two parts and has a bottom plate which is typically attached on the machine frame. A top plate is pivotally attached on this bottom plate, so that the doctor blade can be lifted off the roller surface, or placed on and pressed against the roller surface (EP 1 567 715 B1, DE 195 08 298 C2 and WO 2009/076 128 A1).

The production of this retaining device is, however, very time-consuming and therefore costly. In addition, a large number of components must be managed, such as cover plates, bottom plates, screws, etc. The assembly is time-consuming, because the many components screwed together and adjusted.

SUMMARY OF THE INVENTION

Based on the DE 195 08 298 C2, it is therefore the object of the invention to provide a device for retaining doctor blades which can be more easily manufactured and assembled.

This object is attained with a device of the aforementioned type according to the invention by integrally forming the support element and the retaining fingers.

The one-piece embodiment of the retaining device has the essential advantage that the number of components is drastically reduced, which also simplifies assembly. The storage is substantially easier.

According to the invention, the support element and the retaining fingers are formed by a bent sheet metal part. Here, one sheet metal section forms the support element and the other sheet metal section forms the retaining finger abutting the support element. The support element and the retaining finger are produced by bending the sheet metal strip by 180°.

Advantageously, the retaining finger and the support element are welded together, in particular laser-welded, in the region before the retaining finger lifts off from the support element. The welding beam advantageously passes through the gap between the free end of the retaining finger and the support element.

A retaining device produced in this way according to the invention can be easily cut to the desired length, for example by sawing.

The retaining finger has a free end that is spaced from the support element. The scraper pocket, into which the scraper blade is inserted and in which it retained, is located behind this gap. The scraper pocket is formed on three sides by the retaining finger and on one side by the support element.

The distance between the free end and the support element has here a defined width. The width of the distance is advantageously adjusted by a saw cut extending parallel to the plane of the support element and is, for example 4.5 mm.

According to a further development of the invention, the support element of the retaining finger may have apertures for receiving adjusting screws and/or fastening screws. These are advantageously punched after the bending operation.

Preferably, the end opposite of the doctor blade, where the support element transitions into the retaining finger, is finish-machined and a pinch edge is removed.

In an advantageous exemplary embodiment of the invention, the free end of the support element has on its top side facing away from the retaining finger a chamfer which is formed by pressing down. This chamfer is used to ensure that dirt is diverted so as not to accumulate upstream of the retaining device.

Further advantages, features and details of the invention are evident from the dependent claims and from the following description in which a preferred embodiment is described. The features shown in the drawing and mentioned in the description and in the claims may be essential for the invention severally or in any combination.

DETAILED DESCRIPTION OF PREFERRED EMBODIMENTS

Figure 2:
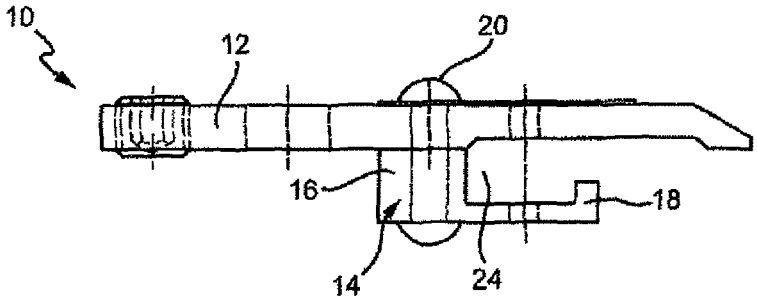
Fig. 2 (Prior Art)
FIG. 2 shows a first retaining device of the prior art according to DE 195 08 298 C2.
Figure 3:
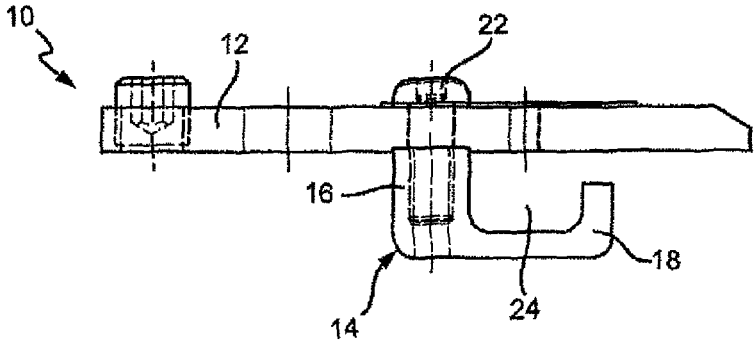
Fig. 3 (Prior Art)
FIG. 3 shows a second retaining device according to the prior art.
Figure 4:
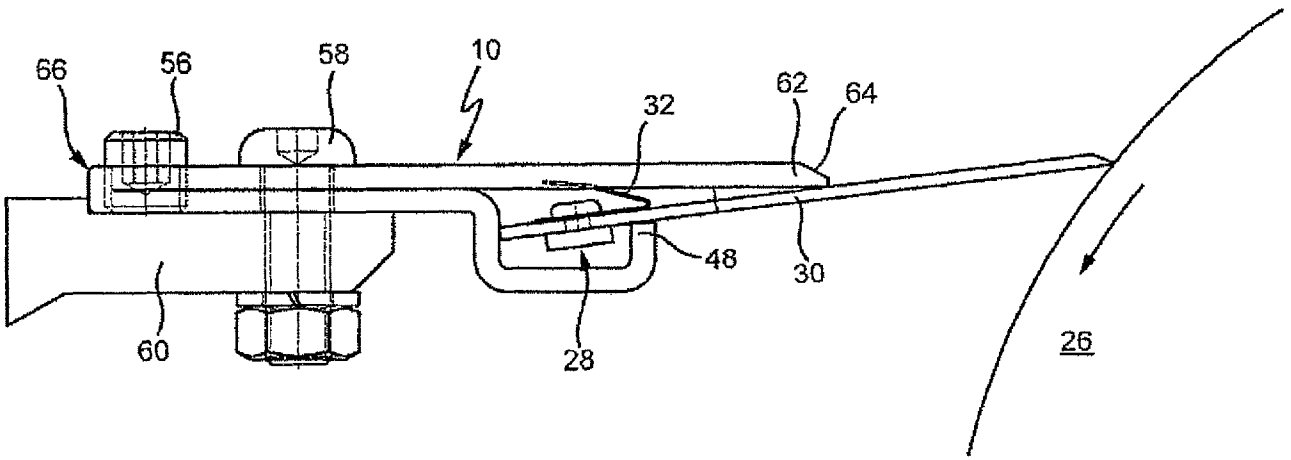
FIG. 4 shows the retaining device according to FIG. 1 after installation and with an inserted doctor blade.

FIGS. 2 and 3 each show a respective retaining device 10, as is known from the prior art. The retaining device 10 includes an upper support element 12 and a lower component 14 having a U-shaped cross-section. One U-leg 16 of the component 14 is not only longer, but also substantially thicker than the other U-leg 18. The one U-leg 16 of the component 14 is permanently connected to the strip-shaped support element 12 with rivets 20 or equivalent elements, such as screws 22. Both create in conjunction a scraper pocket 24 which in the drawing is open to the right and accommodates the free end 28 of a scraper blade 30 facing away from a roller 26 (see FIG. 4). The free end 28 may advantageous be provided with spring elements 32, formed for example as leaf springs or shackle springs, which are preferably supported on the bottom side of the strip-shaped support element 12 and thereby retain the scraper blade 30 without allowing movement. As can be clearly seen, the retaining device 10 is composed of a plurality of discrete elements, namely a support element 12, a component 14 and several rivets 20 or screws 22.

Figure 1:
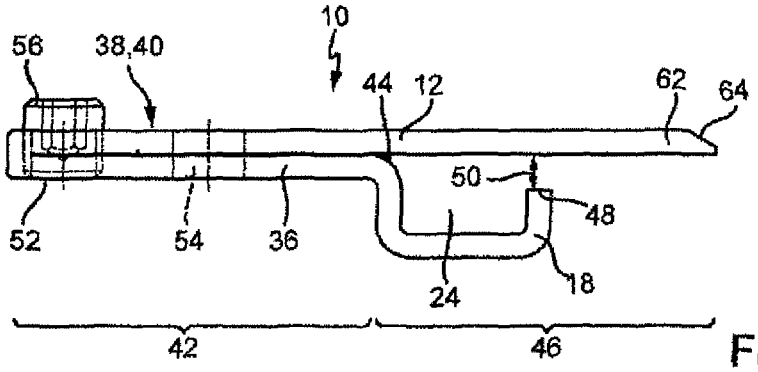
FIG. 1 shows a cross section through the retaining device according to the invention.

FIG. 1 shows an exemplary embodiment of a retaining device 10 according to the invention with a support element 12 and a retaining finger 36 which are both formed from a single sheet-metal strip 38. The sheet-metal strip 38 is a bent sheet-metal part 40 having a uniform thickness and made for example of stainless steel. In a first section 42, the support element 12 and the retaining fingers 36 abut each other and are welded together at the transition 44 to a second section 46, e.g. by using a laser. The free end 48 of the leg 18 has in relation to the support element 12 a distance 50 with a precise dimension. This dimension is adjusted by a saw cut parallel to the support element 12 and between the support element 12 and the free end 48. As is also apparent, apertures 52 and 54 (e.g. in the form of drilled holes) are provided in section 42, in which adjusting screws 56 and fastening screws 58 are inserted. The fastening screws 58 are used to attach the retaining device 10 to a machine frame 60, while the retaining device 10 can be slightly tilted with the adjusting screws 56, whereby the doctor blade 30 can be matched, for example, to a camber of a roller 26.

Lastly, it is apparent that the free end 62 of the support element 12 is provided with a chamfer 64 formed by pressing. This ensures that the dirt scraped off by the doctor blade 30 is diverted. The squeezed edge 66 was finish-machined, for example by grinding, so that the retaining device 10 rests fully and flat on the machine frame 60.

The invention claimed is:

1. A device for retaining a doctor blade, the device comprising:

a support element, and a retaining finger having a doctor blade pocket, wherein the support element and the retaining finger are formed as a single piece and the doctor blade is inserted between the support element and the retaining finger, wherein the support element and the retaining finger are formed of a single bent sheet-metal part having a uniform sheet-metal thickness and the retaining finger comprises a first section abutting the support element and a second section constructed to lift off or move away from the support element, wherein the retaining finger is welded to the support element in a transition region disposed between the first section and the second section.

2. The device of claim 1, wherein the retaining finger is welded to the support element in the transition region by a laser weld.

3. The device of claim 1, wherein the second section of the retaining finger comprises a free end having a spacing to the support element.

4. The device of claim 3, wherein the spacing has a defined width.

5. The device of claim 4, wherein the width of the spacing is adjusted by a saw cut extending parallel to a plane of the support element.

6. The device of claim 1, wherein the support element and the retaining finger comprise apertures constructed to receive adjusting screws or fastening screws, or both.

7. The device of claim 1, wherein an end of the device distal from the doctor blade, where the support element transitions into the retaining finger, is finish-machined and burr-free.

8. The device of claim 1, wherein the support element comprises a free end having a chamfer disposed on a top side of the support element facing away from the retaining finger.

9. The device of claim 8, wherein the chamfer is produced by pressing.

* * * * *